US010914096B1

(12) United States Patent
Hovagimian-Beck et al.

(10) Patent No.: US 10,914,096 B1
(45) Date of Patent: Feb. 9, 2021

(54) TENT WITH TRANSPARENT TOP

(71) Applicants: Holly Hovagimian-Beck, Vernon Hills, IL (US); Brian Polk, Buffalo Grove, IL (US)

(72) Inventors: Holly Hovagimian-Beck, Vernon Hills, IL (US); Brian Polk, Buffalo Grove, IL (US)

( * ) Notice: Subject to any disclaimer, the term of this patent is extended or adjusted under 35 U.S.C. 154(b) by 0 days.

(21) Appl. No.: 16/242,680

(22) Filed: Jan. 8, 2019

Related U.S. Application Data

(60) Provisional application No. 62/614,768, filed on Jan. 8, 2018.

(51) Int. Cl.

| | |
|---|---|
| ***E04H 15/10*** | (2006.01) |
| ***E04H 15/42*** | (2006.01) |
| ***E04H 15/64*** | (2006.01) |
| ***E04H 15/60*** | (2006.01) |
| ***E04H 15/56*** | (2006.01) |

(52) U.S. Cl.
CPC ..... *E04H 15/64* (2013.01); *E04H 15/10* (2013.01); *E04H 15/42* (2013.01); *E04H 15/56* (2013.01); *E04H 15/60* (2013.01)

(58) Field of Classification Search
CPC ..... E04H 15/10; E04H 15/42; E04H 15/62
USPC ..... 135/156, 157, 158, 160
See application file for complete search history.

(56) References Cited

U.S. PATENT DOCUMENTS

| | | | | |
|---|---|---|---|---|
| 2,159,273 | A * | 5/1939 | Killinger | E04H 15/001 135/125 |
| 2,511,452 | A * | 6/1950 | Anderson | E04H 15/001 135/157 |
| 2,847,017 | A * | 8/1958 | Drago | E04H 15/42 135/157 |
| 3,058,480 | A * | 10/1962 | Blanchard | E04H 15/42 135/97 |
| 3,424,178 | A * | 1/1969 | Yazaki | A01G 9/16 135/157 |
| 3,799,608 | A * | 3/1974 | Smutny | E04H 1/1205 297/184.14 |
| 4,719,935 | A | 1/1988 | Gustafson | |
| 4,858,635 | A | 8/1989 | Eppenbach | |
| 5,335,685 | A * | 8/1994 | Dahulich | E04H 15/322 135/118 |
| 5,606,986 | A | 3/1997 | Muise | |
| 6,499,497 | B1 | 12/2002 | Swetish et al. | |
| 8,375,969 | B2 * | 2/2013 | McCarty, Sr. | E04H 15/34 135/122 |
| 2005/0092355 | A1 | 5/2005 | Hsu | |

(Continued)

OTHER PUBLICATIONS

Black Diamond Skylight Tent: 3-Person 3-Season. Product listing [online]. © Backcountry.com [retrieved on Aug. 29, 2017]. Retrieved from the Internet: <URL:htips://www.backcountry.com/black-diamond-skylight-tent-3-person-3-season>.

*Primary Examiner* — Noah Chandler Hawk

(74) *Attorney, Agent, or Firm* — Cramer Patent & Design, PLLC; Aaron R. Cramer

(57) ABSTRACT

A tent includes a domed-shaped modular frame and a tent cover attachable to the frame and having a door, a transparent top, and rain cover. The rain cover also has a transparent top. A shield is selectively positioned on the interior of the tent cover to cover the transparent top. The transparent top of the tent cover and rain cover are resistant to ultraviolet radiation.

17 Claims, 11 Drawing Sheets

(56) References Cited

U.S. PATENT DOCUMENTS

2006/0213546 A1* 9/2006 Mitsui ..... E04H 15/42
135/121
2007/0295378 A1* 12/2007 Lapping ..... E04H 15/44
135/121

* cited by examiner

TENT WITH TRANSPARENT TOP

RELATED APPLICATIONS

The present invention is a continuation of and claims the benefit of U.S. Provisional Application No. 62/614,768, filed Jan. 8, 2018, the entire disclosures of which are incorporated herein by reference.

FIELD OF THE INVENTION

The present invention relates to tents having transparent tops.

BACKGROUND OF THE INVENTION

As many people know, camping, hunting and other outdoor activities are among today's most popular leisure activities. While various camping equipment is used depending upon different types of camping and a person's particular tastes and activities, just about all of these collections will usually include a tent.

Tents provide for the basic protection from the elements and a surface to sleep upon in order to avoid sleeping on the hard ground. Additionally, tents provide protection from inclement weather such as rain, snow or strong wind. However, while its very important for the tent to provide shelter and protection, oftentimes the tent structure prohibits the viewing and enjoyment of nature from within the tent. Accordingly, there is a need for a means by a tent which provides suitable protection from the elements likewise provides a viewing opportunity of the environment outside of the tent. The development of present invention fulfills this need.

SUMMARY OF THE INVENTION

The disadvantages of the prior art are overcome by the present invention in providing a tent assembly having a transparent tent top which is attached to the tent assembly, a plurality of segmented rods each of which are routed through one of a plurality of sleeves on each corner of the tent assembly, each of the segmented rods have a first end to terminate in a connector angle socket which is generally a "Y"-shaped connector, a plurality of grommets of which each are located at each corner of a plurality of tent sidewalls—the grommets provide a location for a second end of each the segmented rods to pass through to and terminate thereat in order to stretch to make the tent assembly as taut as possible in order to provide as much usable interior space as is achievable, a bottom opaque section including a pair of short sides and a pair of long sides, a plurality of connectors which are installed on each the segmented rods—the connectors are oriented adjacent a transition point between the bottom opaque section and the transparent tent top of the tent assembly; the segmented rods each have a distal end attached to open a connector lateral socket of each the connectors, each one of the connectors have a protrusion on an upper facing portion to assist in retention of a rain fly, the protrusion is located at a transition point between a connector first lateral socket, a connector second lateral socket, and a connector angle socket, and a pair of door flaps which are located at a tent front—the pair of door flaps is bifurcated into two equal portions with the pair being removably conjoined by a fastener to enable access to an interior of the tent assembly.

In a separate embodiment the tent assembly may also comprise, in addition to the above, a rain fly which includes a continuous rain fly sidewall and a rain fly top. The rain fly is capable of being attached to the tent assembly, and staked to the ground surface via one or more anchors, to cover at least a portion of an outside of the tent assembly. Each of the connectors have a protrusion on an upper facing portion to assist in retention of a rain fly. A plurality of loops may be located on a perimeter adjacent to or on a bottom edge of the continuous rain fly sidewall. The rain fly is fully extended and secured on the tent assembly. Additionally, the transparent rain fly top is coextensive with the transparent tent top. The separate embodiment may also include a plurality of ties, each of which includes a first end which is secured to a respective loop and attached to the tent assembly and a second end secured to a respective anchor. A plurality of receivers may be disposed on an underside of the rain fly, typically located immediately adjacent to the transition point between the rain fly top and the rain fly sidewall, the receivers are sized and located to receive the protrusions located on the connecters to provide additional secure retainment of the rain fly to the tent assembly. A cover is also provided that is capable of being attached to an interior surface of the tent assembly to fully or partially cover the transparent top.

The tent top may be transparent, weatherproof, and waterproof. It is further envisioned that the transparent top is removably attached to the tent assembly by a tent top attachment means selected from the group consisting of a zipper, a plurality of buttons, a plurality of snaps, or a plurality of tie points, on either side of a mesh or a mosquito netting. The segmented rods may be fiberglass. The tent front may be a higher distance from a ground surface so as to encourage drainage of water, snow, ice, or debris via gravity towards a tent rear and ultimately off the tent top. The higher distance may be in the range of two-and-one-half to four inches. The interior of the tent assembly may comprise a floor.

The floor, when present, is generally coextensive with an outer perimeter of the opaque portion of the tent assembly. The tent assembly may be weatherproof and waterproof. The tent assembly may also be generally rectangular and planar when laid flat.

The rain fly top may be transparent while the ties are elastic and/or resilient. The cover may be attached with a cover attachment means which is selected from the group consisting of a zipper, a plurality of buttons, a plurality of buttons snaps, or a plurality of buttons tie-points.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
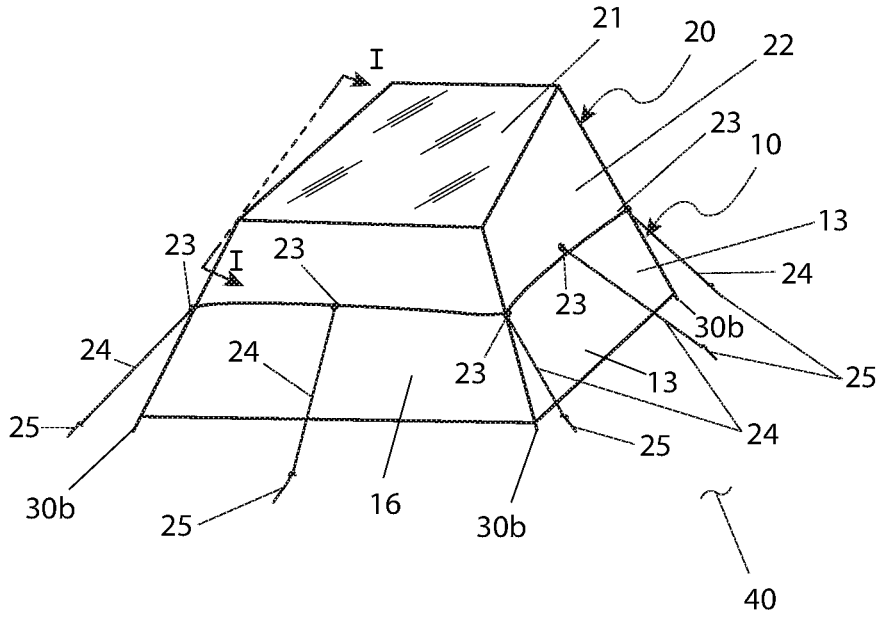
FIG. 1 is a perspective view of a rain fly 20 covering a tent assembly 10, according to the preferred embodiment of the present invention.

10 tent assembly
11 fastener
12 door flap
13 tent sidewall
15 tent front
16 tent rear
17 tent top
19 mesh
20 rain fly
21 rain fly top
22 rain fly sidewall
23 loop
24 tie
25 anchor
30*a* long rod
30*b* short rod
30*c* top rod
31 connector
32 protrusion
33 receiver
35*a* connector first lateral socket
35*b* connector second lateral socket
35*c* connector angle socket
40 ground
44 tent top attachment means
45 grommet
46 sleeve
48 cover
49 cover attachment means

1. DESCRIPTION OF THE INVENTION

The best mode for carrying out the invention is presented in terms of its preferred and various alternate embodiments, herein depicted within FIGS. 1 through 9*b*. However, the invention is not limited to the described embodiments, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

The present invention relates to a tent assembly 10 having a transparent tent top portion 17. Please refer to FIGS. 3-5*d*. The tent assembly 10 itself incorporates typical features commonly associated with collapsible tents, such as segmented rods 30*a*, 30*b*, 30*c* that rout through sleeves 46 on the tent sidewalls 13, 15, 16 and grommets 45 located at the bottoms of the tent sidewalls 13, 15, 16. The tent assembly 10 is preferably a generally weatherproof and waterproof material that is generally rectangular and planar when laid flat and incorporates a bottom opaque section (herein described as the tent sidewalls 13, tent front 15, and tent rear 16) and a transparent tent top 17. The transparent tent top 17 is also generally shaped as a rectangle or possibly a square. All portions of the tent top 17 are transparent, weatherproof, and waterproof. The bottom opaque section includes a pair of short sides (i.e., two (2) tent sidewalls 13) and a pair of long sides (i.e., a tent front 15 and a tent back 16). A pair of door flaps 12 are located at the tent front 15 and can be additional features attached to the tent front 15, or more preferably, the tent front 15 is bifurcated into two (2) equal portions, designated as the door flaps 12. The door flaps 12 are preferably removably conjoined by a fastener 11, such as a zipper, to enable access to an interior.

The sleeves 46 that the long and short rods 30*a*, 30*b* rout through can either be on the inside or the outside. In the preferred embodiment, and most clearly shown in FIG. 5*a*, the sleeves 46 are oriented on the outside surface of the tent assembly 10. In a preferred embodiment, at least one (1) segmented long rod 30*a* or plurality of long rods 30*a* is routed through sleeves 46 each of the corners of the tent assembly 10 at the tent front 15, each having a first end to terminate in one (1) connector angle socket 35*c* of a generally "Y"-shaped connector 31. Similarly, at least one (1) segmented short rod 30*b* or plurality of short rods 30*b* is routed through each of the corners of the tent assembly 10 at the tent rear 16, each also having a first end to terminate in one (1) connector angle socket 35*c* of a generally "Y"-shaped connector 31. Essentially, the long rods 30*a* delineate the transition between the tent front 15 and the tent sidewalls 13 and the short rods 30*b* delineate the transition between the tent rear 16 and the tent sidewalls 13. Located at each corner of the tent assembly 10, (i.e. the transition points between the tent sidewalls 13 and the tent front 15, and the transition points between the tent sidewalls 13 and tent rear 16) is a grommet 46. The grommets 46 provide a location for the second ends of the long rods 30*a* and short rods 30*b* to pass through to and terminate thereat in order to stretch to make the tent assembly 10 as taut as possible in order to provide as much usable interior space as can be achieved.

Figure 2:
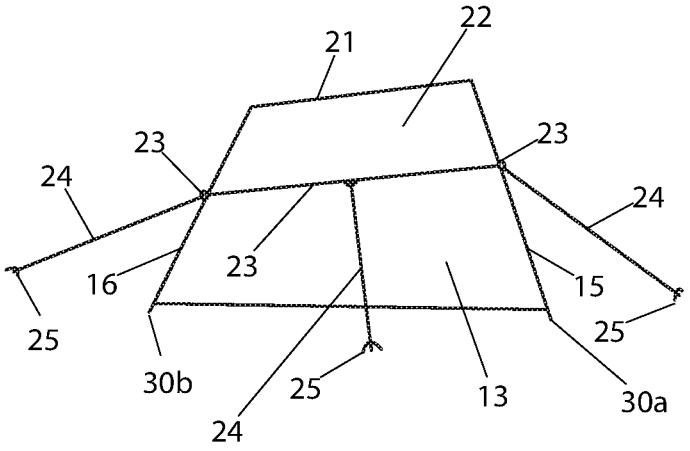
FIG. 2 is a side view of the rain fly 20 covering the tent assembly 10, according to the preferred embodiment of the present invention.
Figure 3:
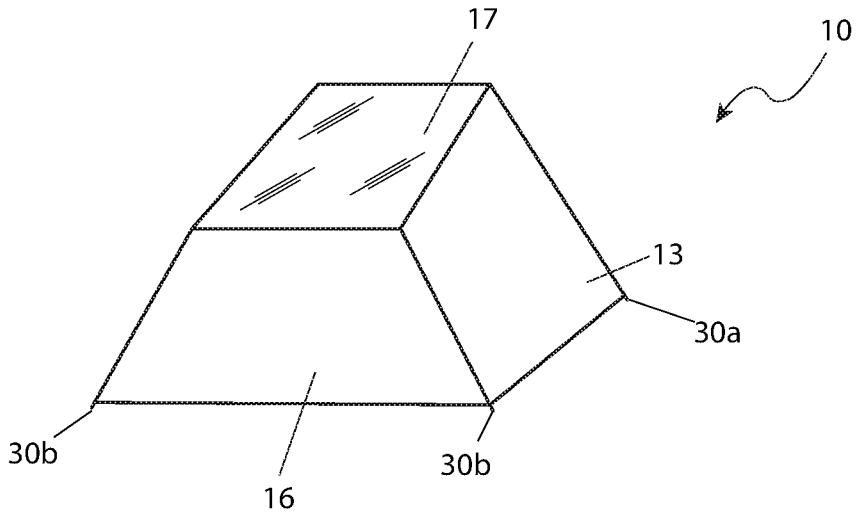
FIG. 3 is a perspective view of the tent 10 assembly with the rain fly 20 removed, according to the preferred embodiment of the present invention.
Figure 4:
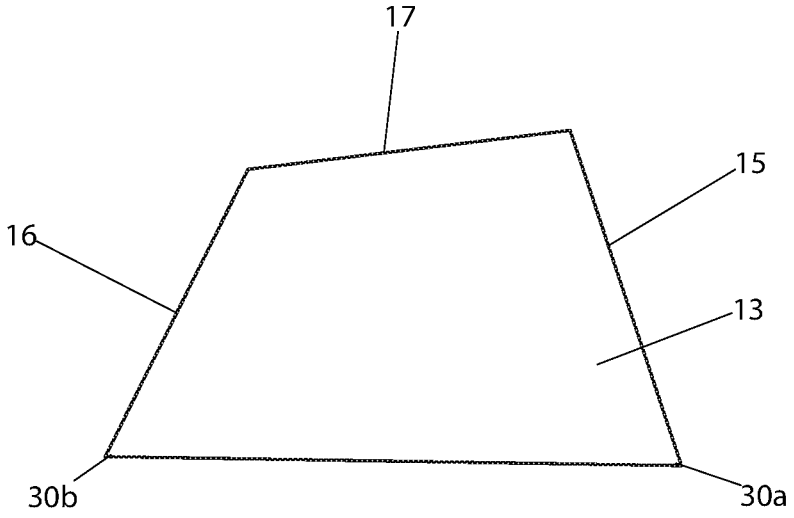
FIG. 4 is a side view of the tent assembly 10 with the rain fly 10 removed, according to the preferred embodiment of the present invention.
Figure 5A:
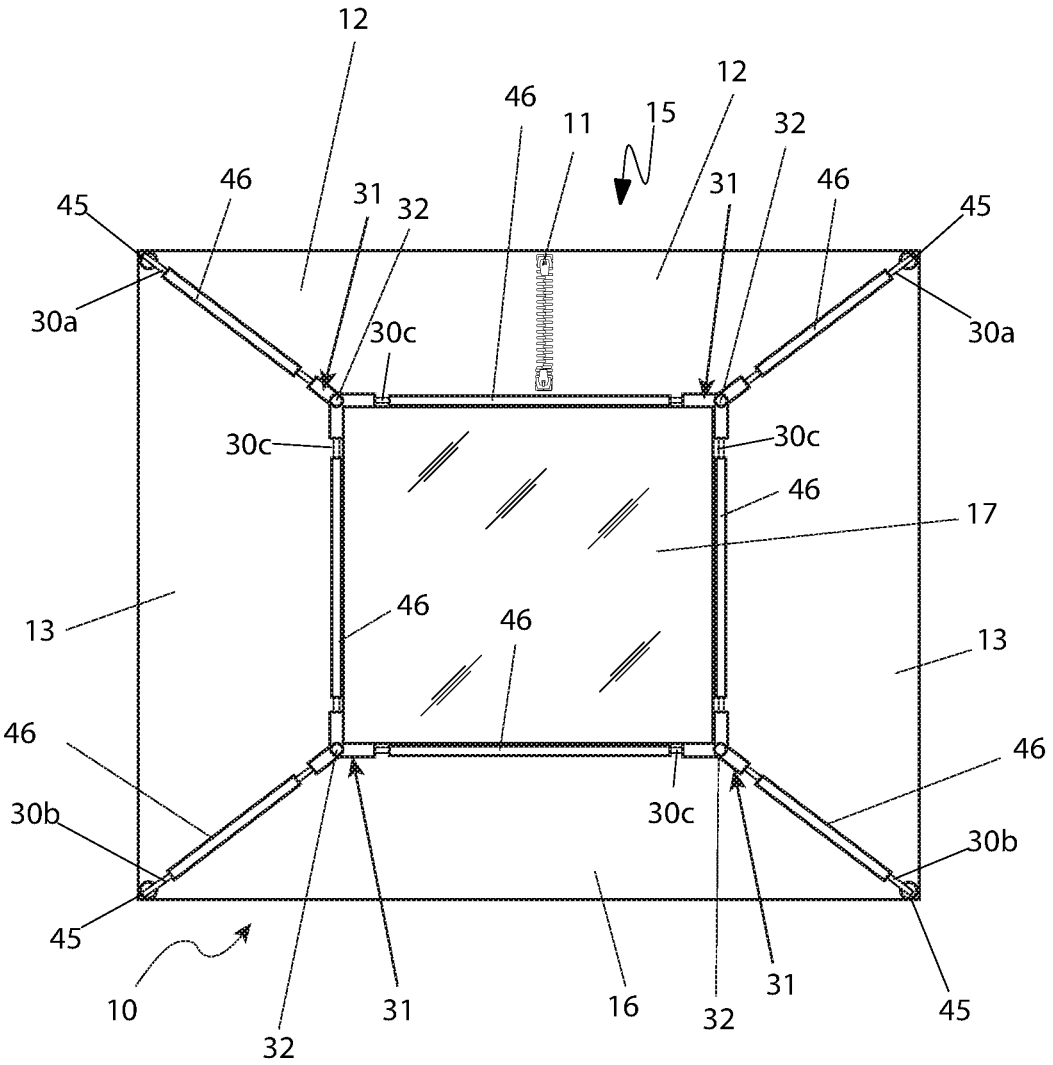
FIG. 5*a* is a top view of the tent assembly 10, according to the preferred embodiment of the present invention.
Figure 5B:
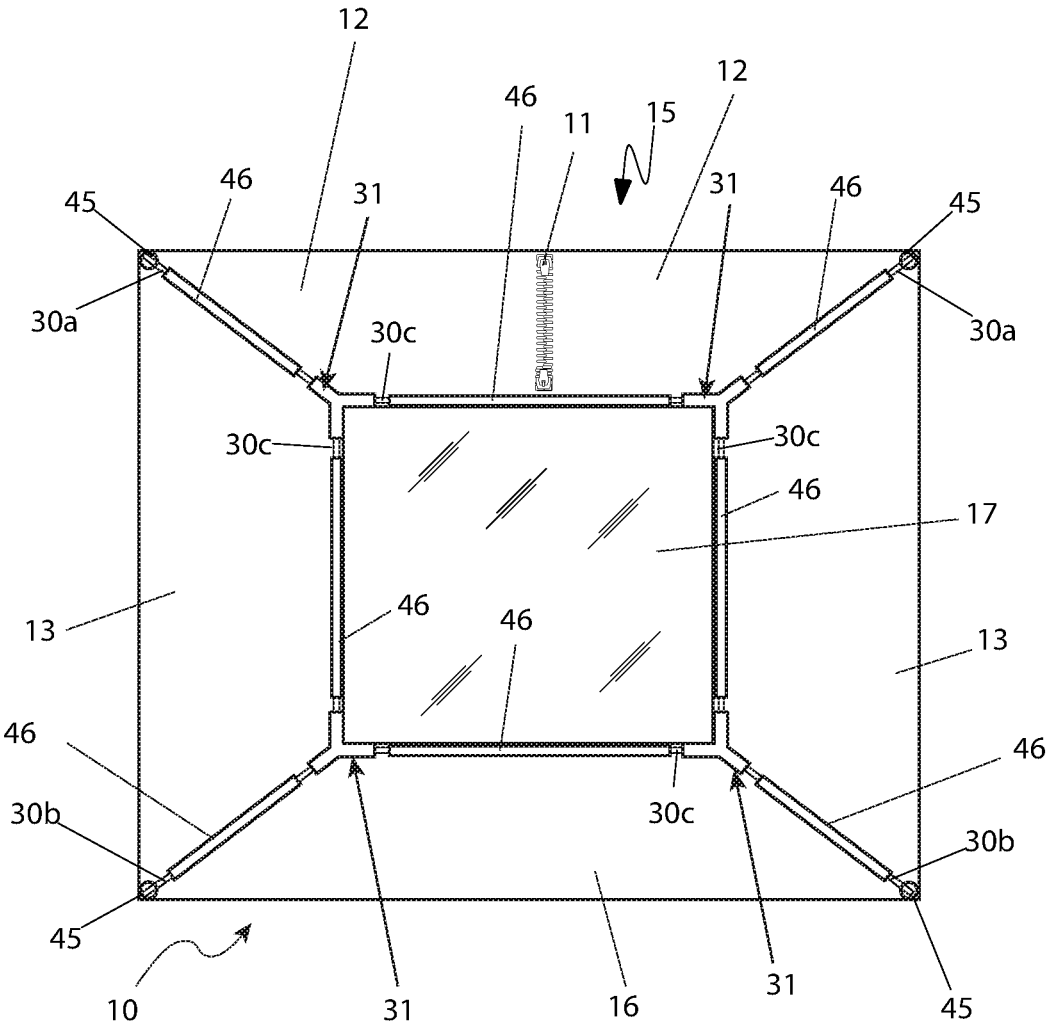
FIG. 5*b* is a bottom view of the tent assembly 10, according to an alternate embodiment of the present invention.
Figure 5C:
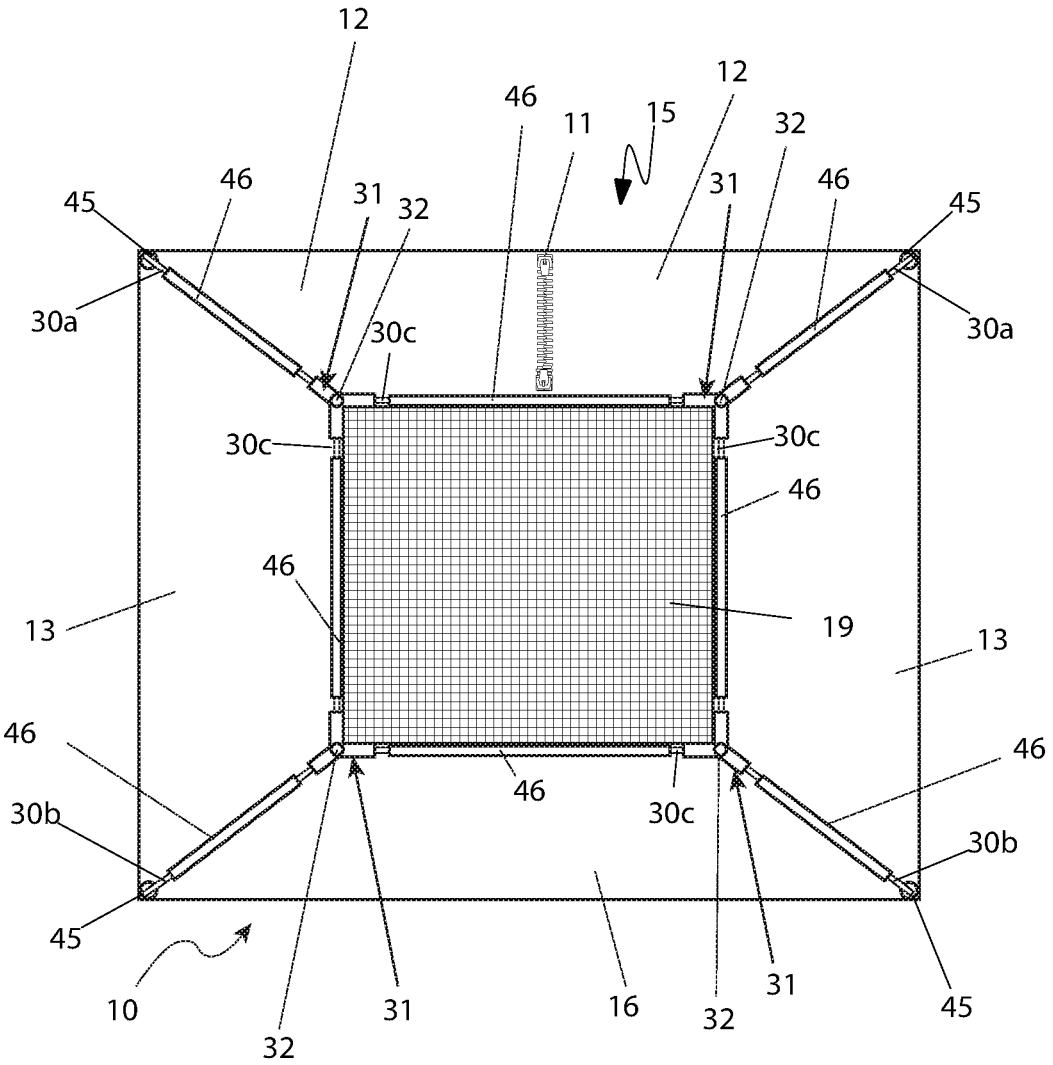
FIG. 5*c* is a top view of the tent assembly 10, according to another alternate embodiment of the present invention.

There are four (4) connectors 31. The connectors 31 are separate from the tent assembly 10, and when installed on the rods 30*a*, 30*b*, 30*c*, are oriented adjacent the transition point between the opaque portion of the tent assembly 10 (i.e. the tent sidewalls 13, the tent front 15, and the tent rear 16) and the transparent tent top 17 of the tent 10. Alternately, the connectors 31 can be oriented where they overlap the transition point. Four (4) segmented top rods 30*c* or individual top rods 30*c* then frame the transparent top 17 portion of the tent 10 into a square. The top rods 30*c* each have distal ends attached to open connector lateral sockets 35*a* or 35*b* of the four (4) connectors 31 as shown in FIG. 5*a*. Each of the connectors 31 have a protrusion 32 on an upper facing portion to assist in retention of a rain fly 20 (described below). The protrusion 31 is located essentially on the transition point between the connector first lateral socket 35*a*, connector second lateral socket 3*tb*, and connector angle socket 35*c* (see FIG. 7). The tent front 15 with the long rods 30*a* terminate in a higher distance from the ground 40 so as to encourage drainage of water, snow, ice, or debris via gravity towards the tent rear 16 and ultimately off the tent top 17. Preferably this difference in height is two-and-one-half to four inches (2½-4 in.). This is best illustrated in FIGS. 2 and 4.

Upon installation of the rods 30*a*, 30*b*, 30*c* in the tent 10 assembly, the tent assembly 10 is therefore configured to have four (4) sides. The opaque portion of the tent assembly 10 thus comprises two (2) continuous tent sidewalls 13 and the tent back 16. The tent front 15 in a preferred embodiment is bisected by a fastener 11, such as a zipper or other similar fastening means to create the pair of door flaps 12. Other locations of the fastener 11 may be appreciated, and the other tent sidewalls 13, tent rear 16, or either door flap 12 may have a window or another door and is thus not a limiting part of the present invention. The fastener 11 therefore provides access to an interior. The interior may have a floor, or there may be no floor at all. If there is a floor, then it is appreciated that the floor may have additional weatherproof or waterproof material and is generally coextensive with an outer perimeter of the opaque portion of the tent assembly 10 (i.e. the tent sidewalls 13, tent front 15, and tent rear 16). Other embodiments may provide for stakes 25 to secure the tent assembly 10 to the ground 40, or alternately the terminal ends of the long rods 30*a* and short rods 30*b* may be spiked to enable penetration and anchorage to the ground 40.

In certain embodiments, a rain fly 20 is included. Please refer to FIGS. 1, 2, and 6. The rain fly 22 comprises a rain fly sidewall 22 and a rain fly top 21. The rain fly sidewall 22 is continuous and has the overall geometrical shape as the tent assembly 10. The rain fly top 21 is transparent and is preferably of identical geometry as the tent top 17. The rain fly 20 is capable of being attached to the tent assembly 10, and staked to the ground 40 via anchors 25, to cover at least a portion of the outside of the tent assembly 10. In order to accomplish this, a plurality of loops 23 are located on the perimeter adjacent to or on the bottom edge of the rain fly sidewall 22. A plurality of ties 24 are included, each having a first end secured to a respective loop 23 and a second end secured to a respective anchor 25. The ties 24 can be elastic or not and are resilient. When the rain fly 20 is fully extended and secured on the tent assembly 10, it is preferred that the transparent rain fly top 21 is coextensive with, or at least coaligned with, the transparent tent top 17.

In a preferred embodiment, there are four (4) receivers 33 on the underside of the rain fly 20, typically located immediately adjacent to the transition point between the rain fly top 21 and the rain fly sidewall 22. These receivers 33 are sized and located to receive the protrusions 32 located on the connecters 31 to provide additional secure retainment of the rain fly 20 to the tent 10. In embodiments where the sleeves 46 are located on the inside surface of the tent assembly 10, such as that shown in FIG. 5*b* which necessitates that the connectors 31 are located on the interior of the tent assembly 10, each receiver 33 is configured to enable the protrusion 32 of an individual connector 31, as well as the material of the tent assembly 10 (either a tent sidewall 13, a tent front 15 (either door flap 12), or tent rear 16) to be entrapped therein (please see FIG. 8).

Figure 9A:
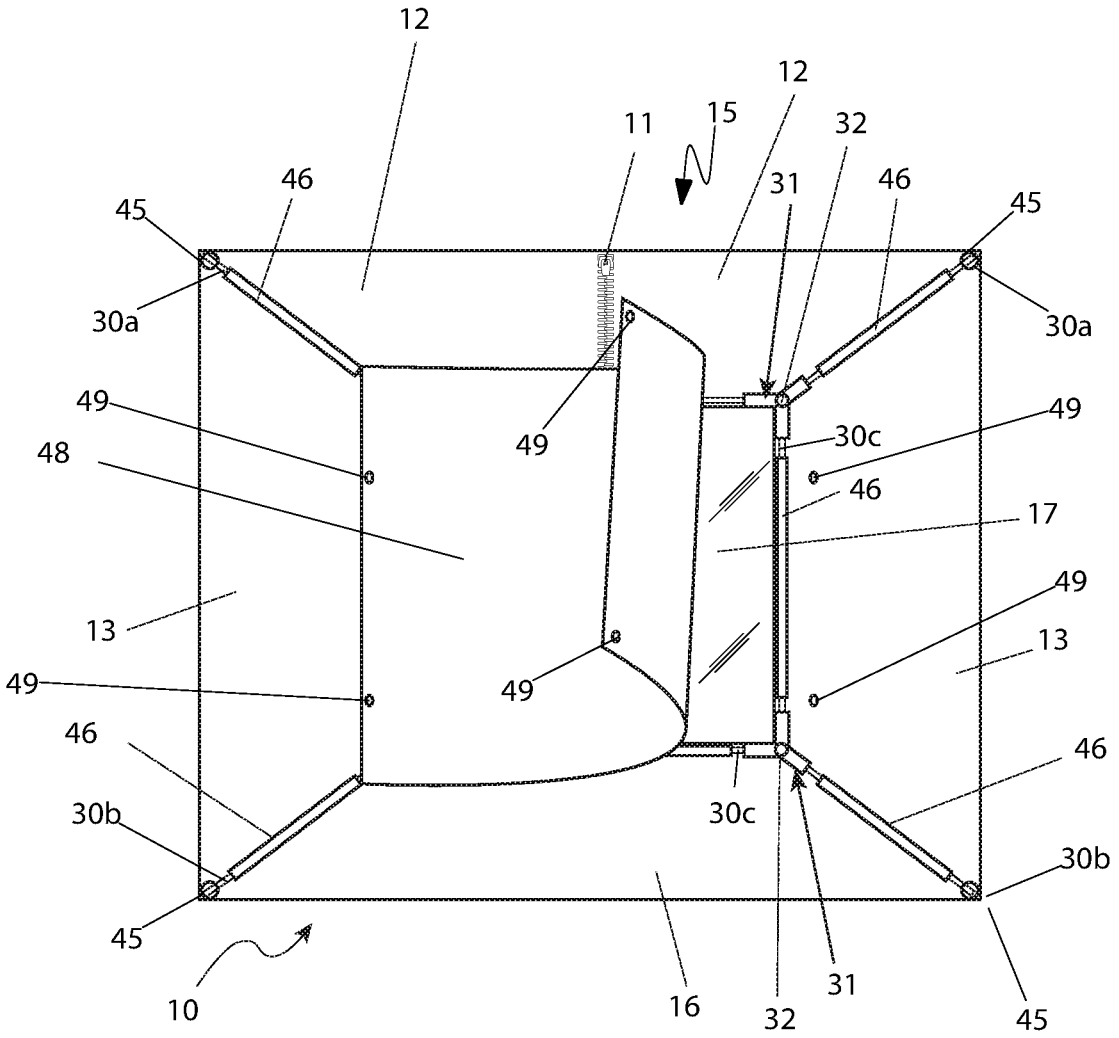
FIG. 9*a* is a top view of the tent assembly 10 with a cover 48, according to an alternate embodiment of the present invention; and, FIG. 9*b* is a bottom view of the tent assembly 10 with a cover 48, according to an alternate embodiment of the present invention.
Figure 9B:
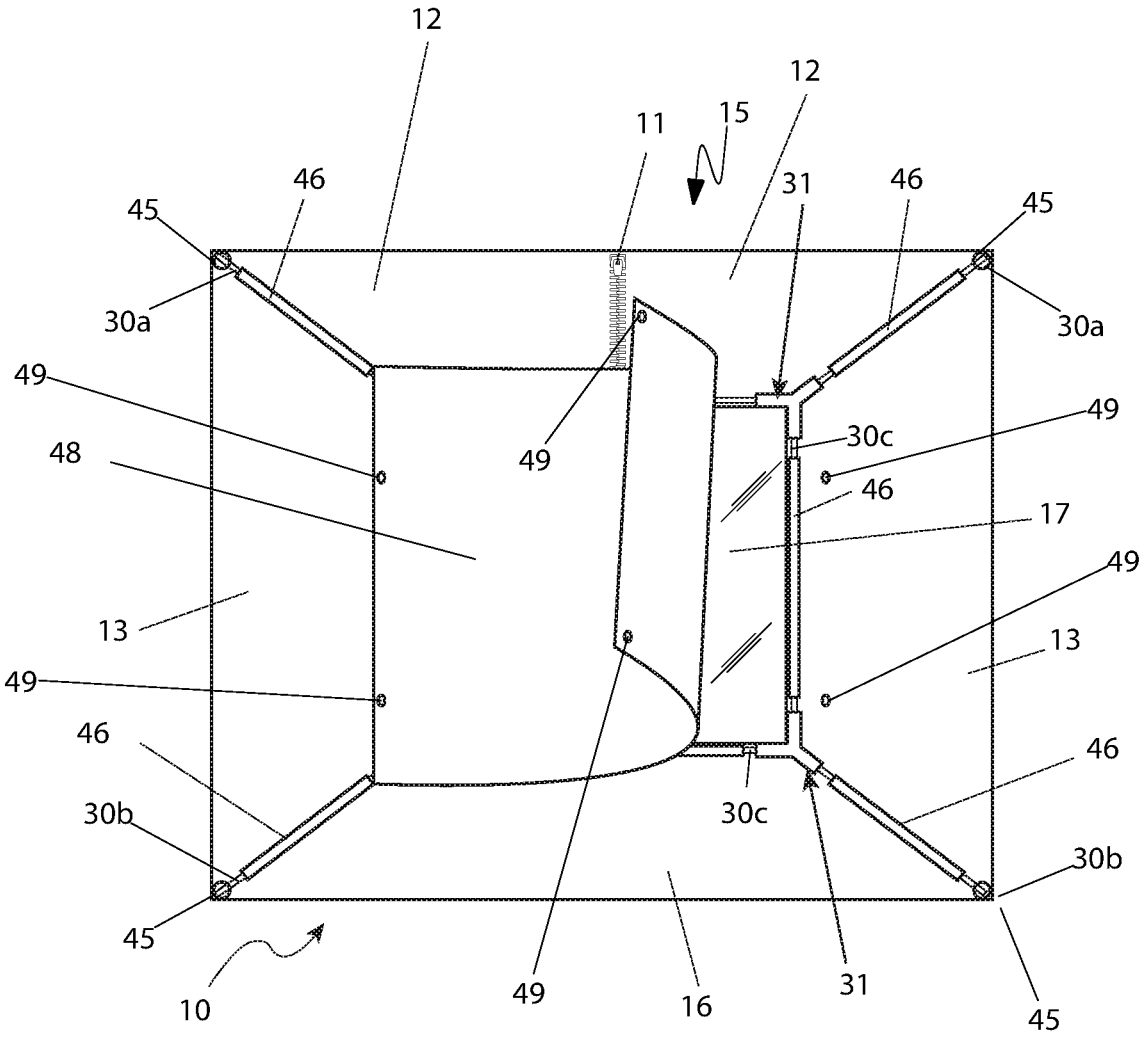

In preferred embodiments, there is a cover 48 that is attached to an interior surface of the tent 10 to fully or partially cover the transparent top 17 when so desired. Although FIG. 9*a* illustrates the location of the cover 48 in the embodiment where the sleeves 46 and connectors 31 are located on the interior surface of the tent assembly 10 (i.e. the tent sidewalls 13, tent front 15, and tent rear 16), it is appreciated that the cover 48 is also present in the embodiment where the sleeves 46 and connectors 31 are located on the exterior surface of the tent assembly 10 (i.e. the tent sidewalls 13, tent front 15, and tent rear 16), such as that shown in FIG. 9*b*. The cover 48 is preferably attached with a cover attachment means 49, which can be a zipper, buttons, snaps, tie-points or the like and may be similar to the tent top attachment means 44 previously described.

Figure 6A:
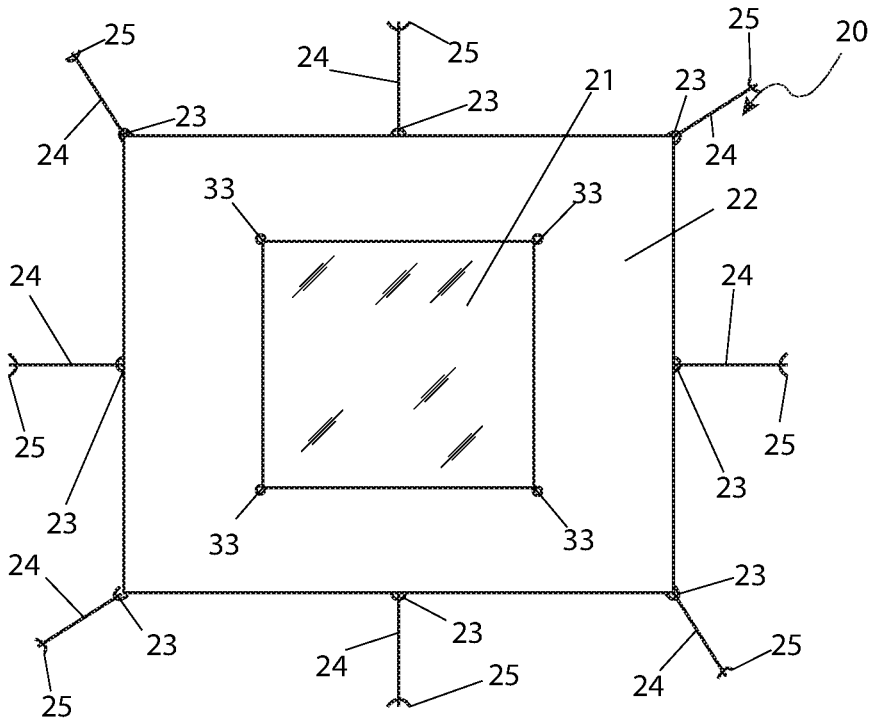
FIG. 6*a* is a bottom view of the rain fly 20, according to the preferred embodiment of the present invention.
Figure 6B:
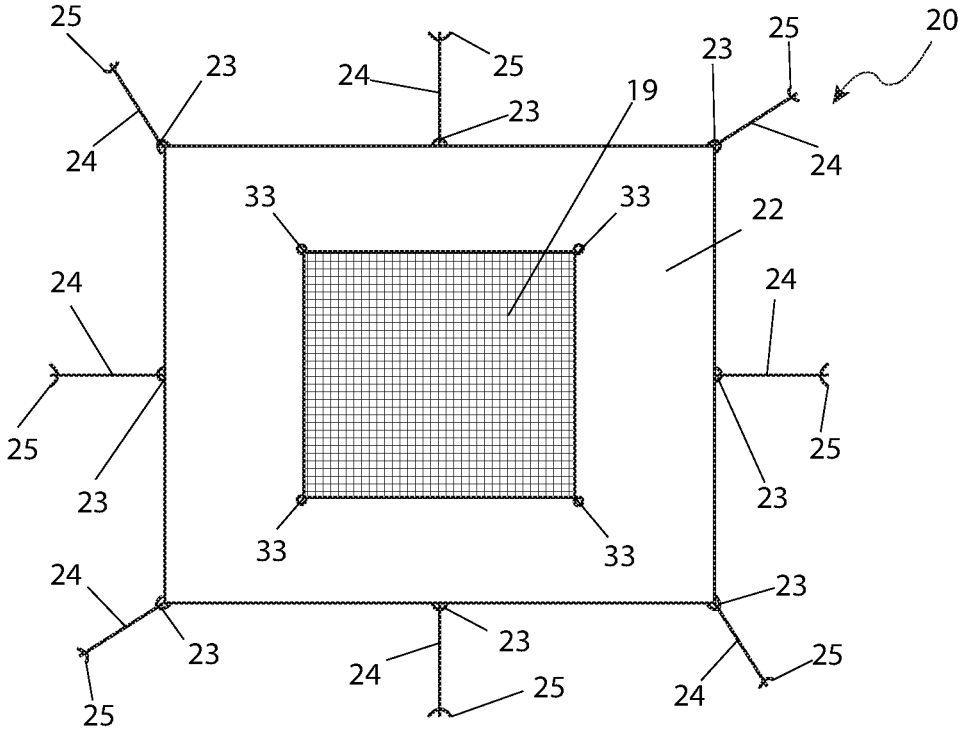
FIG. 6*b* is a bottom view of the rain fly 20, according to an alternate embodiment of the present invention.
Figure 7:
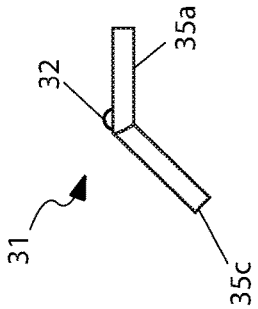
FIG. 7 is a side view of a connector 31, according to the preferred embodiment of the present invention.
Figure 8:
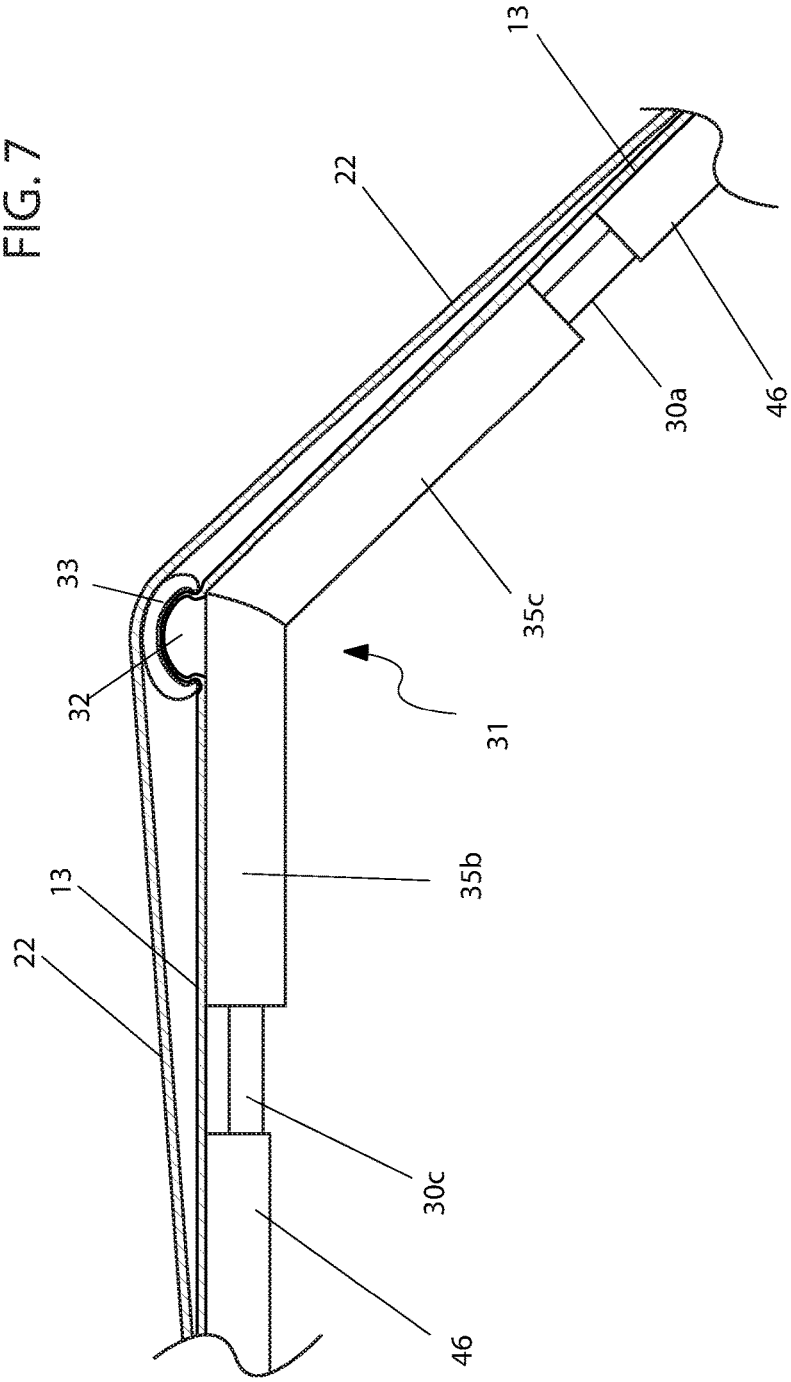
FIG. 8 is a cut away view along the line I-I (please see FIG. 1), of the attachment point between the rain fly 20, connector 31, and tent assembly 10, according to an alternate embodiment of the present invention.

In other embodiments, the tent top is a mesh 19 or mosquito netting material (FIG. 5*c*), while the rain fly top 21 is transparent. Conversely, the tent top 17 can be transparent, while the rain fly top 21 can be a mesh 19 or mosquito netting material (FIG. 6*b*).

Figure 5D:
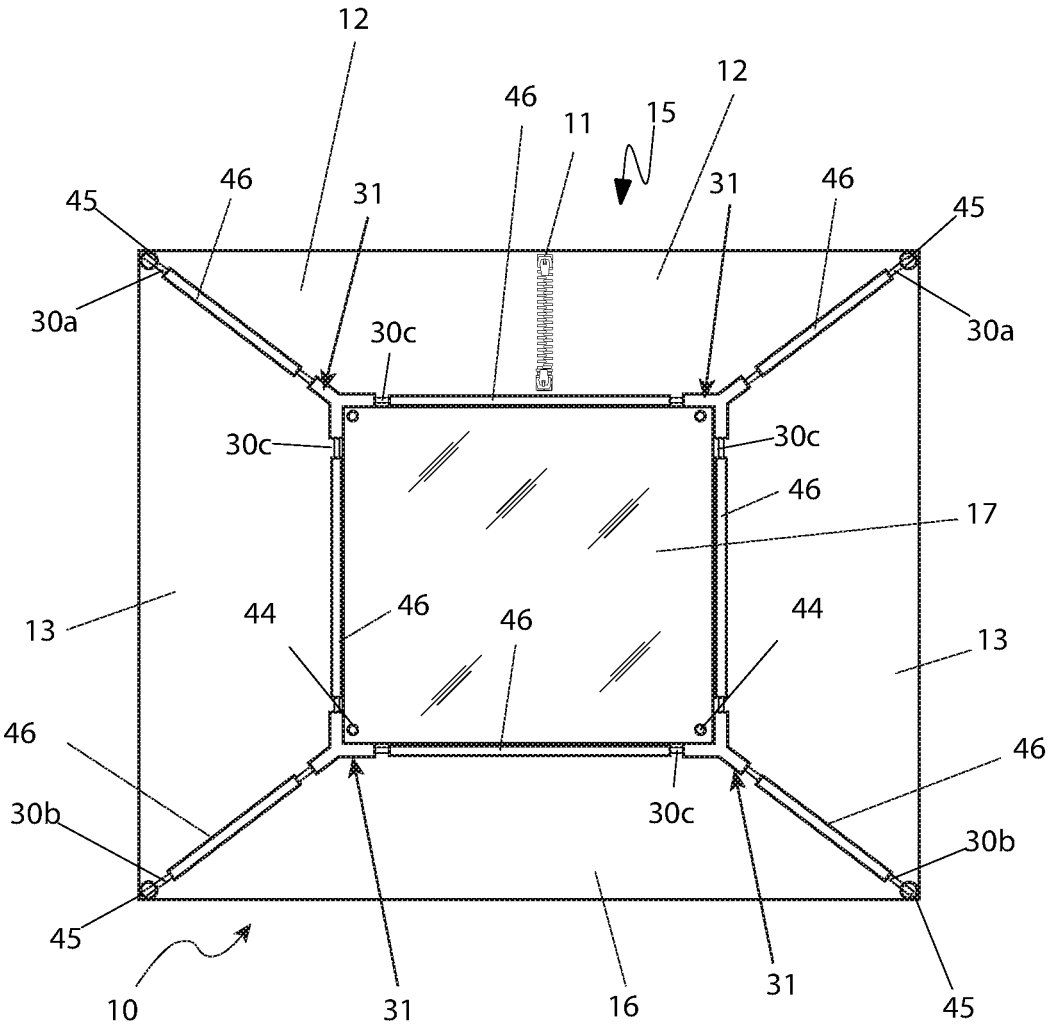
FIG. 5*d* is a bottom view of the tent assembly 10, according to yet another alternate embodiment of the present invention.
Figure 5E:
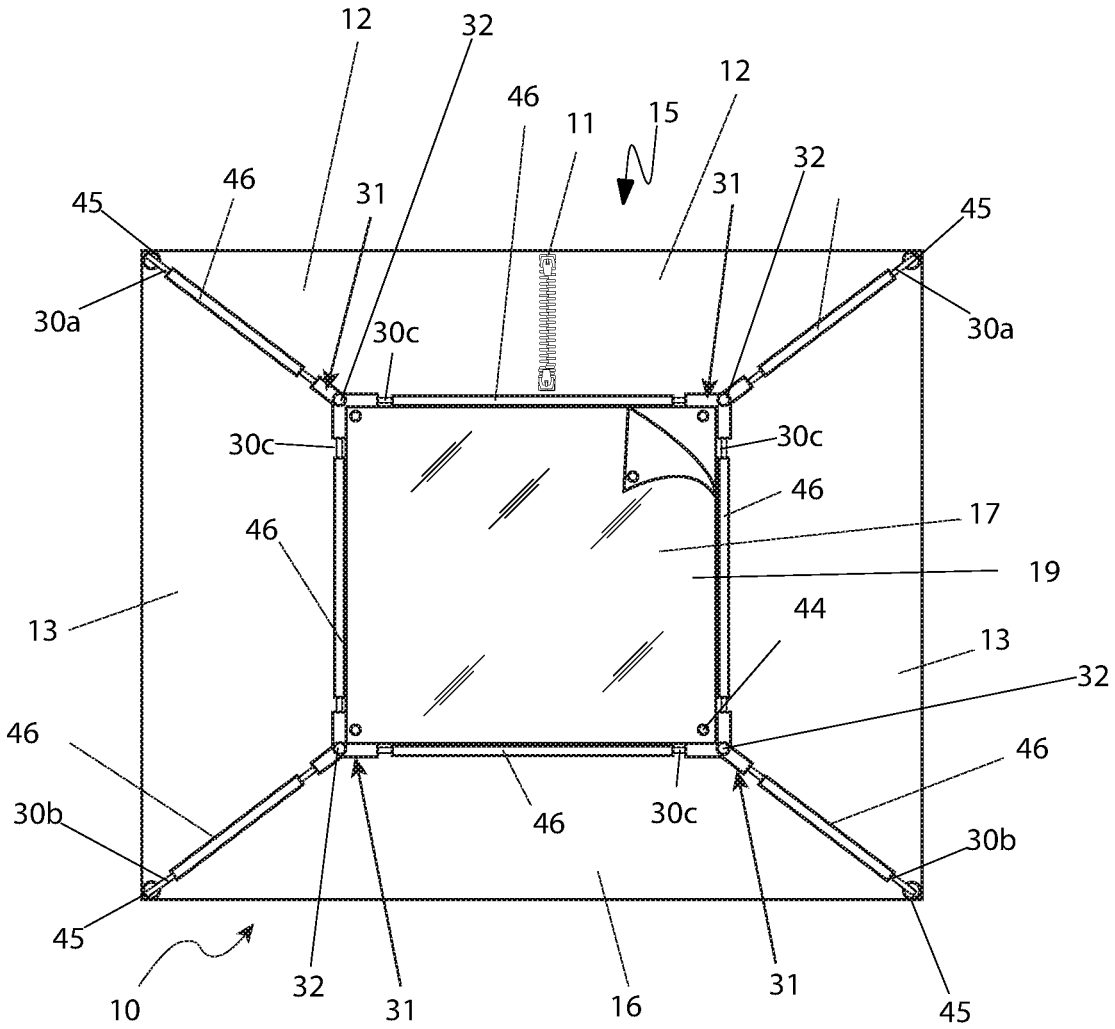
FIG. 5*e* is a top view of the tent assembly 10, according to still yet another alternate embodiment of the present invention.

Still other embodiments provide for the transparent top 17 to be removably attached to the tent assembly 10 (i.e. the tent sidewalls 13, tent front 15, and tent rear 16) with a tent top attachment means 44, either by a zipper, buttons, snaps, or tie points, on either side of the mesh or mosquito netting if available, or in place of (e.g., wherein the top portion 17 of the tent 10 is completely open), as is illustrated in FIGS. 5*d* and 5*e*. and may be similar to the cover top attachment means 49 previously described.

Any or all of the transparent material for the top portion 17 of the tent 10 and the rain fly top 21 is resistant to ultraviolet radiation. The rods 30*a*, 30*b*, 30*c* can be fiberglass, and as mentioned above, can be segmented and interconnected with each other with elastic material.

The invention claimed is:

1. A tent assembly, comprising:

a tent assembly first side;

a tent assembly second side;

a tent assembly third side;

a tent assembly fourth side;

a tent assembly bottom side; and;

a tent assembly opaque portion comprising said tent assembly first side, said tent assembly second side, said tent assembly third side, said tent assembly fourth side and said tent assembly bottom side;

wherein said tent assembly first side, said tent assembly second side, said tent assembly third side, said tent assembly fourth side and said tent assembly bottom side are joined together forming a square frustrum defining a tent assembly interior having a tent assembly open top;

a transparent tent top attached to said tent assembly open top;

a plurality of segmented rods each routed through one of a plurality of sleeves on each corner of said tent assembly, each said segmented rods having a first end to terminate in a connector angle socket of a connector;

a plurality of grommets each located at a corner of said square frustrum, said grommets provide a location for a second end of each said segmented rods to pass through to and terminate thereat in order to stretch to make said tent assembly taut;

a pair of door flaps located at said tent assembly first side, said pair of door flaps is bifurcated into two equal portions, said pair of door flaps are removably conjoined by a fastener to enable access to said tent assembly interior;

wherein each said connector is oriented adjacent a transition point between said tent assembly opaque portion and said transparent tent top, each said connector having a protrusion on an upper facing portion to assist in retention of a rain fly, said protrusion is located at a transition point between a connector first lateral socket, a connector second lateral socket, and a connector angle socket; and, wherein said tent assembly opaque portion comprises a pair of short sides and a pair of long sides.

2. The tent assembly according to claim 1, wherein said transparent tent top weatherproof and waterproof.

3. The tent assembly according to claim 1, wherein said transparent tent top is removably attached to said tent assembly open top by a transparent tent top attachment means selected from the group consisting of a zipper, a plurality of buttons, a plurality of snaps, or a plurality of tie points, on either side of a mesh or a mosquito netting.

4. The tent assembly according to claim 1, wherein said segmented rods are fiberglass.

5. The tent assembly according to claim 1, wherein said tent assembly first side is above a ground surface so as to encourage drainage of water, snow, ice, or debris via gravity towards a tent rear and ultimately off said tent top.

6. The tent assembly according to claim 5, wherein said tent assembly first side is in the range of two-and-one-half to four inches above the ground surface.

7. The tent assembly according to claim 1, wherein said tent assembly is weatherproof and waterproof.

8. The tent assembly according to claim 1, wherein said tent assembly is generally rectangular and planar when laid flat.

9. A tent assembly, comprising:

a tent assembly first side;

a tent assembly second side;

a tent assembly third side;

a tent assembly fourth side;

a tent assembly bottom side;

a tent assembly opaque portion comprising said tent assembly first side, said tent assembly second side, said tent assembly third side, said tent assembly fourth side and said tent assembly bottom side;

wherein said tent assembly first side, said tent assembly second side, said tent assembly third side, said tent assembly fourth side and said tent assembly bottom side are joined together forming a square frustrum defining a tent assembly interior having a tent assembly open top;

a transparent tent top attached to said tent assembly open top;

a plurality of segmented rods each routed through one of a plurality of sleeves on each corner of said tent assembly, each said segmented rods having a first end to terminate in a connector angle socket of a connector;

a plurality of grommets each located at a corner of said square frustrum, said grommets provide a location for a second end of each said segmented rods to pass through to and terminate thereat in order to stretch to make said tent assembly taut;

a pair of door flaps located at said tent assembly first side, said pair of door flaps is bifurcated into two equal portions, said pair of door flaps are removably conjoined by a fastener to enable access to said tent assembly interior, said tent assembly first side comprises a tent assembly first side height which is greater than a tent assembly third side height so as to encourage drainage of water, snow, ice, or debris via gravity towards said tent assembly third side and ultimately off said transparent tent top or a rain fly;

wherein said rain fly comprises a continuous rain fly sidewall and a transparent rain fly top, said rain fly is capable of being attached to said tent assembly, and staked to said ground surface via one or more anchors, to cover at least a portion of an outside of said tent assembly, each said connector having said protrusion on an upper facing portion to assist in retention of a rain fly, a plurality of loops are located on a perimeter adjacent to or on a bottom edge of said continuous rain fly sidewall, said rain fly is fully extended and secured on said tent assembly, wherein said transparent rain fly top is coextensive with said transparent tent top;

a plurality of ties each including having a first end secured to a respective loop attached to said tent assembly first side, said tent assembly second side, said tent assembly third side and said tent assembly fourth side and a second end secured to a respective anchor;

a plurality of receivers disposed on an underside of said rain fly, located immediately adjacent to a transition point between said transparent rain fly top and said rain fly sidewall, said receivers are sized and located to receive said protrusions located on said connecters to secure retainment of said rain fly to said tent assembly; and a cover that is attached to an interior surface of said tent assembly to fully or partially cover said transparent rain fly top;

a pair of door flaps located at said tent assembly first side, said pair of door flaps is bifurcated into two equal portions, said pair of door flaps are removably conjoined by a fastener to enable access to said tent assembly interior;

wherein each said connector is oriented adjacent a transition point between said tent assembly opaque portion and said transparent tent top, each said connector having a protrusion on an upper facing portion to assist in retention of a rain fly, said protrusion is located at a transition point between a connector first lateral socket, a connector second lateral socket, and a connector angle socket; and, wherein said tent assembly opaque portion comprises a pair of short sides and a pair of long sides.

10. The tent assembly according to claim 9, wherein said transparent tent top is weatherproof and waterproof.

11. The tent assembly according to claim 9, wherein said transparent tent top is removably attached to said tent assembly open top by a transparent tent top attachment means selected from the group consisting of a zipper, a plurality of buttons, a plurality of snaps, or a plurality of tie points, on either side of a mesh or a mosquito netting.

12. The tent assembly according to claim 9, wherein said tent assembly first side is in the range of two-and-one-half to four inches above said ground surface.

13. The tent assembly according to claim 9, wherein said tent assembly is weatherproof and waterproof.

14. The tent assembly according to claim 9, wherein said tent assembly is generally rectangular and planar when laid flat.

15. The tent assembly according to claim 9, wherein said ties are elastic.

16. The tent assembly according to claim 9, wherein said ties are resilient.

17. The tent assembly according to claim 9, wherein said cover is attached with a cover attachment means selected from the group consisting of a zipper, a plurality of buttons, a plurality of buttons snaps, or a plurality of buttons tie-points.

* * * * *